US008225855B2

(12) United States Patent
Ramsey et al.

(10) Patent No.: US 8,225,855 B2
(45) Date of Patent: Jul. 24, 2012

(54) SURFACE EQUIPMENT ASSEMBLY FOR WELLBORE CABLE

(75) Inventors: Robert Michael Ramsey, Missouri City, TX (US); Matthew E Wilson, Eureka, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 210 days.

(21) Appl. No.: 12/609,492

(22) Filed: Oct. 30, 2009

(65) Prior Publication Data

US 2010/0108331 A1 May 6, 2010

Related U.S. Application Data

(60) Provisional application No. 61/197,710, filed on Oct. 30, 2008, provisional application No. 61/141,705, filed on Dec. 31, 2008.

(51) Int. Cl.
*E21B 29/12* (2006.01)

(52) U.S. Cl. ..... 166/55; 166/85.5

(58) Field of Classification Search ..... 166/361, 166/376, 385, 85.5, 55
See application file for complete search history.

(56) References Cited

U.S. PATENT DOCUMENTS

| | | | | |
|---|---|---|---|---|
| 2,794,619 | A | 6/1957 | Lawrence et al. | |
| 3,073,388 | A | 1/1963 | Chenault | |
| 3,358,765 | A * | 12/1967 | Le Blanc | 166/301 |
| 4,388,969 | A | 6/1983 | Marshall et al. | |
| 4,431,067 | A | 2/1984 | Tullos et al. | |
| 4,603,578 | A | 8/1986 | Stoltz | |
| 4,660,635 | A | 4/1987 | Wittrisch | |
| 4,671,312 | A | 6/1987 | Bruton et al. | |
| 4,844,210 | A | 7/1989 | Wong et al. | |
| 4,886,115 | A | 12/1989 | Leggett et al. | |
| 6,763,753 | B1 | 7/2004 | Brumley et al. | |
| 6,805,197 | B2 | 10/2004 | Brumley et al. | |
| 6,834,721 | B2 * | 12/2004 | Suro | 166/297 |
| 6,997,262 | B2 | 2/2006 | Palmer et al. | |
| 7,264,060 | B2 | 9/2007 | Wills et al. | |
| 2002/0152856 | A1 | 10/2002 | Brumley | |

FOREIGN PATENT DOCUMENTS

JP 2003333720 * 11/2003

* cited by examiner

*Primary Examiner* — William P Neuder
(74) *Attorney, Agent, or Firm* — David J. Smith; Michael L. Flynn; Jody Lynn DeStefanis

(57) ABSTRACT

An embodiment of a clamping, cutting, and wiping assembly assembly may comprise a frame defining a pathway for a cable to pass therethrough, a clamp mechanism, a cutter device, and a wiper mounted to the frame adjacent the pathway for engaging with a cable, wherein the clamp device, the cutter, and the wiper may each be actuatable.

14 Claims, 7 Drawing Sheets

SURFACE EQUIPMENT ASSEMBLY FOR WELLBORE CABLE

CROSS-REFERENCE TO RELATED APPLICATIONS

This application is entitled to the benefit of, and claims priority to, provisional patent application Ser. No. 61/197,710 filed Oct. 30, 2008, and provisional application Ser. No. 61/141,705 filed Dec. 31, 2008, the entire disclosures of which are incorporated herein by reference.

BACKGROUND

The statements in this section merely provide background information related to the present disclosure and may not constitute prior art. The system and method relate in general to wellbore cables.

Embodiments disclosed herein are related in general to wellsite surface equipment such as wireline surface equipment and the like.

Wireline surface equipment typically comprises equipment for guiding the cable into the wellbore and includes a wiper or wipers for keeping the cable clean during wellbore operations, a clamp for clamping the cable to prevent its movement, and cutters for cutting the cable if necessary. Clamps may comprise long, smooth grippers with replaceable inserts work well when dry, but may require twice as much clamping pressure to overcome the effects of grease and other friction reducing contaminants on the cable surface.

It remains desirable to provide improvements in wellsite surface equipment in efficiency, flexibility, reliability, and maintainability.

SUMMARY

An embodiment of a clamping, cutting, and wiping assembly assembly may comprise a frame defining a pathway for a cable to pass therethrough, a clamp mechanism, a cutter device, and a wiper mounted to the frame adjacent the pathway for engaging with a cable, wherein the clamp device, the cutter, and the wiper may each be remotely actuatable. The assembly may further comprise at least one roller guide mounted to the frame adjacent the pathway. Each of the clamp mechanism, the cutter device, and the wiper may further comprise an actuator for activating each of the clamp mechanism, the cutter device, and the wiper. The clamp mechanism may define a center portion for receiving the cable and a pair of opposing members for clamping the cable when actuated.

The clamp mechanism is adjustable to clamp to selectable cable diameters. The clamp members may define at least one groove on engagement surfaces thereof for engaging with the cable. The clamp members may further comprise an insert removably disposed in at least one of the clamp members. The assembly may further comprise at least one roller attached to the frame for moving the assembly along a surface. The assembly may adapted to be mounted in a subsea location. At least one of the clamp mechanism, the cutter device, and the wiper may be attachable to the cable after the cable has been placed in the wellbore.

In an embodiment, a method for performing a wellbore operation in a subterranean formation penetrated by a wellbore comprises providing a wellbore cable, providing a clamping, cutting and wiping assembly, introducing the wellbore cable into the wellbore, arranging the clamping, cutting, and wiping assembly adjacent the with the wellbore cable, and performing at least one wellbore operation with the wellbore cable. Arranging may performed prior to introducing. Arranging may be performed subsequent to introducing. The method may further comprise engaging the wellbore cable with the assembly. Introducing may comprise introducing the cable into a subsea wellbore.

In an embodiment, a clamping assembly for a cable entering a wellbore comprises a housing defining a pathway for a cable to pass therethrough, and a clamp mechanism mounted to the housing and comprising at least a pair of opposing members for clamping and arresting movement of the cable, the opposing members adjustable to clamp to cables of selected diameters. The assembly may further comprise a cutter device, and a wiper mounted to the housing. The opposing members may define at least one groove on engagement surfaces thereof for engaging with the cable. The opposing members may further comprise an insert removably disposed in at least one of the opposing members. The clamp mechanism may further comprise a remotely operated actuator for actuating the clamp mechanism.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1A:
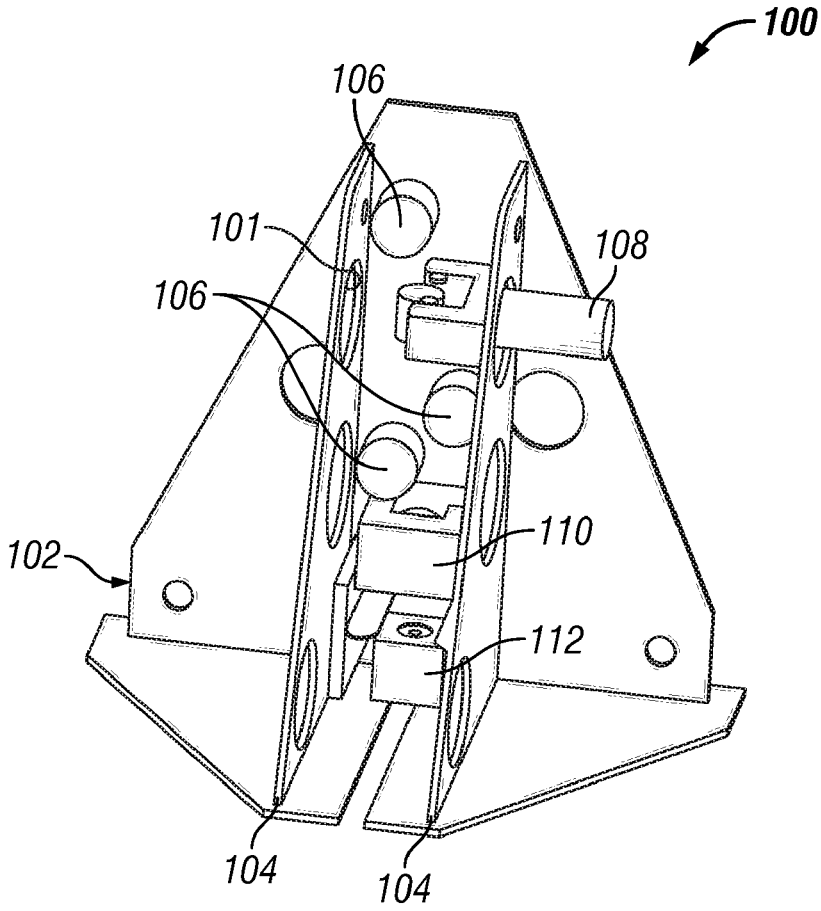
FIG. 1*a* is a schematic side view of an embodiment of a CCW assembly

Referring now to all of the Figures, there is shown an embodiment of a clamping, cutting, and wiping (CCW) assembly, indicated generally at 100. The CCW assembly 100 is preferably adapted to be mounted on wellsite pressure control equipment (not shown), mounted over the rotary table (not shown) of a drill platform (not shown) during wellbore operations such as wireline logging, or the like, as will be appreciated by those skilled in the art. The assembly 100 comprises a frame or housing 102 having a pair of spaced apart flanges 104 defining a pathway therebetween in which are mounted a plurality of guide rollers 106, a cutter device 108, a clamp mechanism 110, and a wiper 112. A cable 105, best seen schematically in FIG. 7, such as a wireline logging cable or the like, is typically routed between the flanges 104, over the guide rollers 106, and through the cutter device 108, the clamp mechanism 110, and a wiper 112 before being routed into a wellbore (not shown). The frame or housing 102 is suitably sized to support a predetermined amount of cable tension, preferably with respect to a predetermined range of cable diameters. The cable 105 may be any type of cable including, but not limited to, a slickline cable, an armored logging cable, a cable having a smooth exterior surface or any elongated device such as a cable suitable for use in wellbore operations.

Figure 1B:
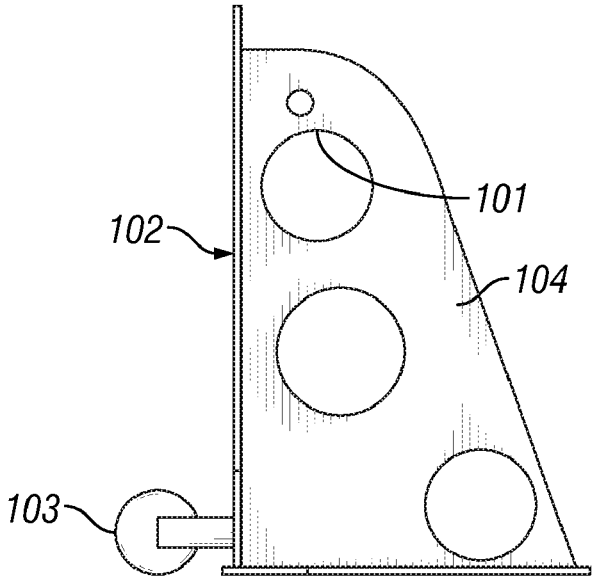
FIG. 1 is a perspective view of an embodiment of a clamping, cutting, and wiping (CCW) assembly.

The frame or housing 102 preferably includes at least one roller 103, best seen in FIG. 1*b*, on a lower portion thereof to enable the CCW assembly 100 to be more easily moved or located on the rotary table. The roller 103 may advantageously allow the CCW assembly 100 to be moved adjacent the cable 105 or away from the cable 105, depending on the requirements of the wellbore operation. The frame or housing 102 may include a high force lifting attachment (not shown) that may attach through an aperture or apertures 101 formed in the flanges 104 of the frame or housing 102 or another suitable location to simplify and/or facilitate pulling up on the logging cable 105.

The guide rollers 106 are rotatably mounted to the housing 102 and function to keep the cable from dragging on the frame of the clamp mechanism 110 and the frame of the cutter mechanism 108. The guide rollers 106 may be adjustable for varying cable diameters and may also comprise a measuring device for measuring cable length as the cable passes thereby and rotates the guide rollers 106 during wellbore operations. The cutter device 108 functions to cut the cable if necessary during the wellbore operation and the wiper 112 functions to keep the cable 105 clean during wellbore operations. The wiper 112 may include inserts for releasably engaging with the outer diameter of the cable 105. The clamp mechanism 110 functions to clamp and hold the cable 105, discussed in more detail below.

Figure 7:
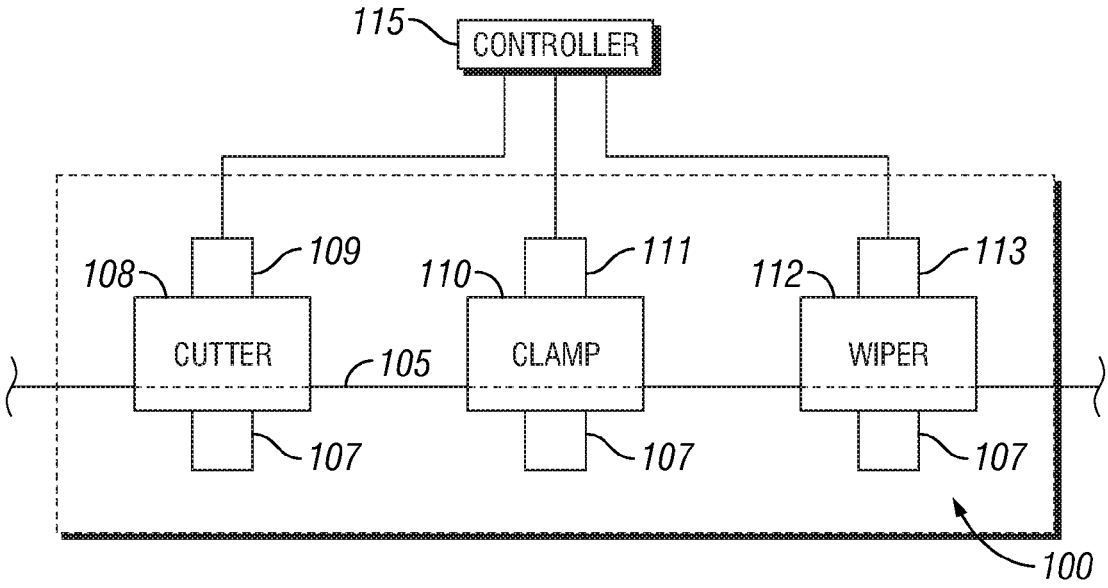
FIG. 7 is a block diagram of an embodiment of an actuation system for a clamp mechanism for an embodiment of a CCW assembly.

The cutter device 108 may include an actuator 109, the clamp mechanism 110 may include an actuator 111, and the wiper 112 may include an actuator 113 in communication with a controller 115 for activating the cutter device 108, the clamp mechanism 110, and the wiper 112 remotely, best seen in FIG. 7. The actuators 109, 111, and 113 may be suitably sized pneumatic or hydraulic actuator in fluid communication with a compressed air supply, a supply of pressurized hydraulic fluid, or the like via suitable plumbing arrangements, such as high pressure hydraulic or pneumatic hoses. The high pressure supply may be, but is not limited to, a 10,000 psi hydraulic pump and routed from the pump to the actuators by suitable control valves. The cutter device 108, the clamp mechanism 110, and the wiper 112 may further comprise a manual actuator 107, such as a hand pump backup actuator or the like, as will be appreciated by those skilled in the art.

Figure 8:
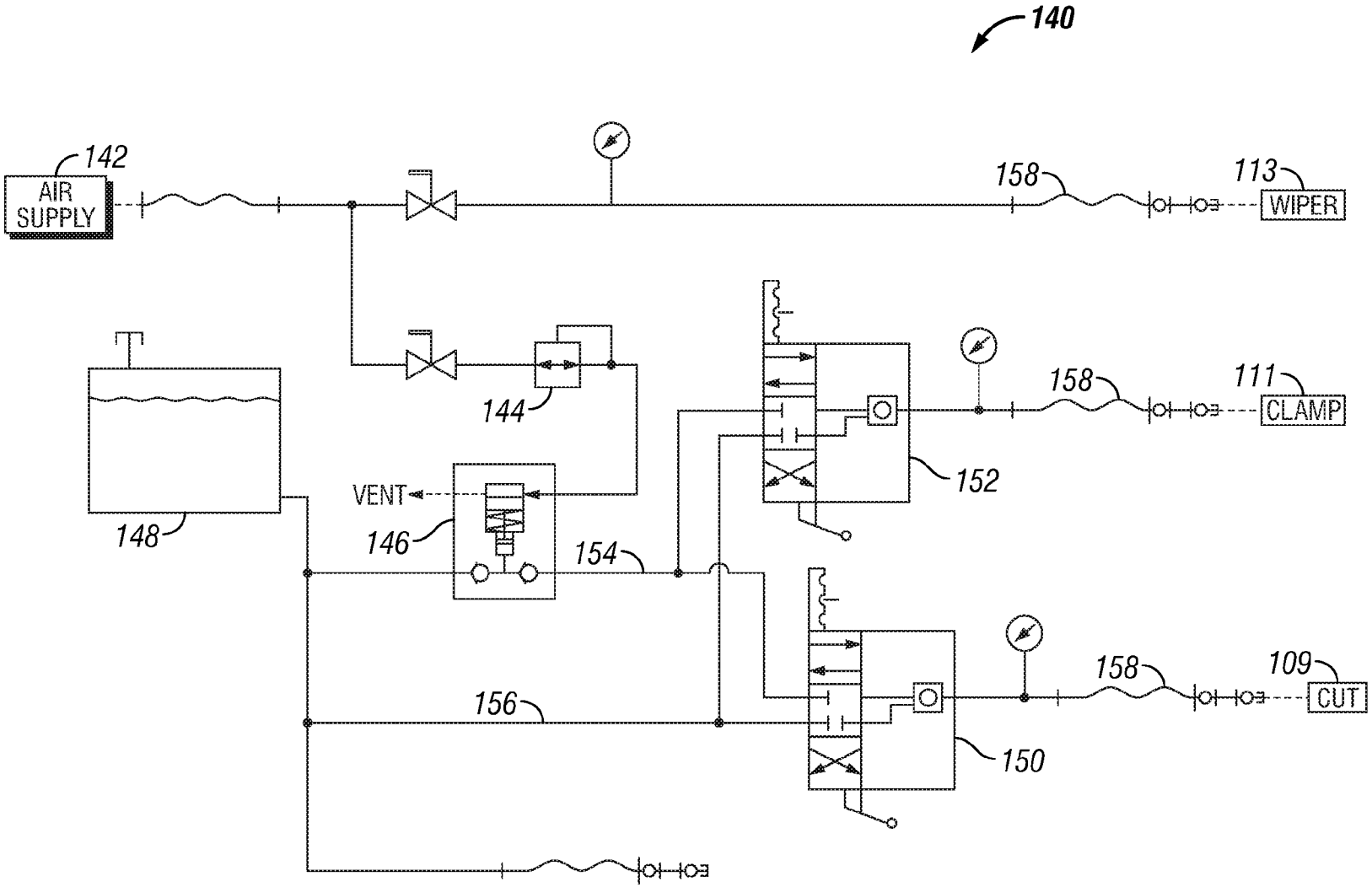
FIG. 8 is a block diagram of an embodiment of an actuation system for a clamp mechanism for an embodiment of a CCW assembly.

An embodiment of an actuation system for the CCW assembly 100 is indicated generally at 140 in FIG. 8. The actuation system 140 is operable to actuate the actuators 109, 111, and 113 of the cutter 108, the clamp mechanism 110, and the wiper 112, respectively. The system 140 comprises a pressurized air supply 142 in communication with the wiper actuator 113 and a regulator 144. The regulator 144 supplies pressurized air to a hydraulic pump or similar pressurizing device 146, which in turn is supplied with hydraulic fluid from a reservoir 148. Hydraulic fluid enters the pump 146 from the reservoir 148, which supplies pressurized hydraulic fluid to a control valve 150 for the actuator 109 and to a control valve 152 for the actuator 111. High pressure lines 154 connect the pump 146 with the valves 150 and 152 and low pressure lines 156 connect the valves 150 and 152 with the reservoir 148. The pressure output of the pump 146 and thus in the high pressure lines 154 is determined by the setpoint of the regulator 144. The actuators 109, 111, and 113 may be connected to their respective pressurized fluid sources via portable high pressure hose connections 158 or the like. The actuation system 140 may be advantageously remotely operated, such as about 50 feet away from the CCW assembly 100

Figure 2:
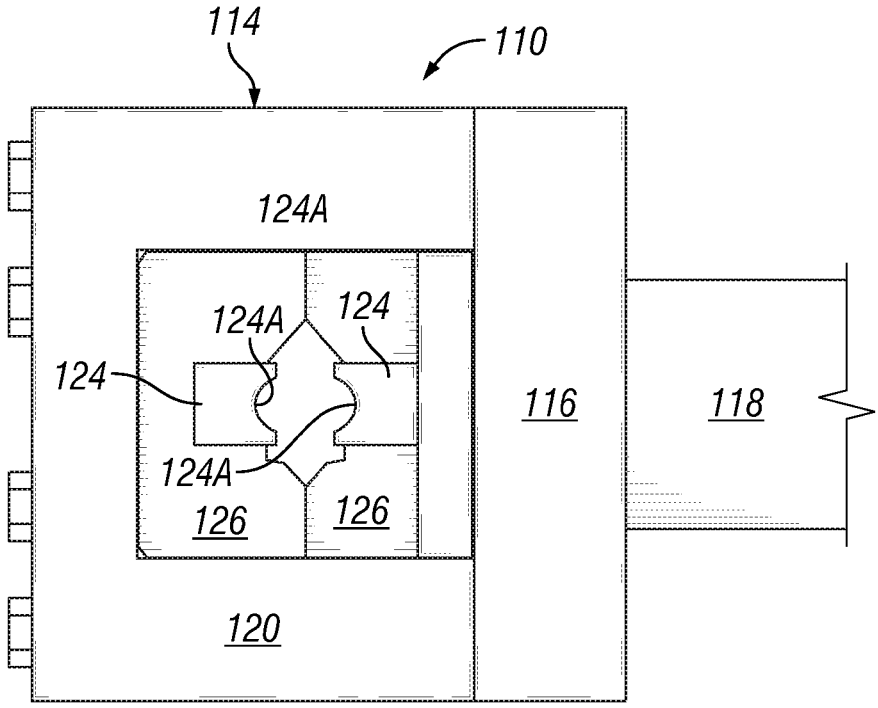
FIGS. 2 through 4 are schematic perspective views, respectively, of an embodiment of a clamp mechanism for an embodiment of a CCW assembly.
Figure 3:
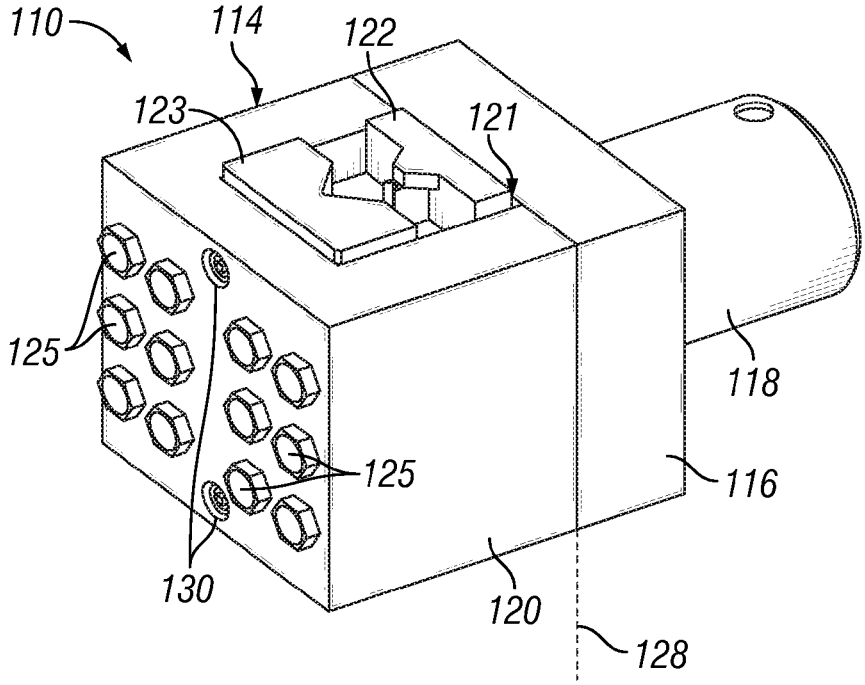
Figure 4:
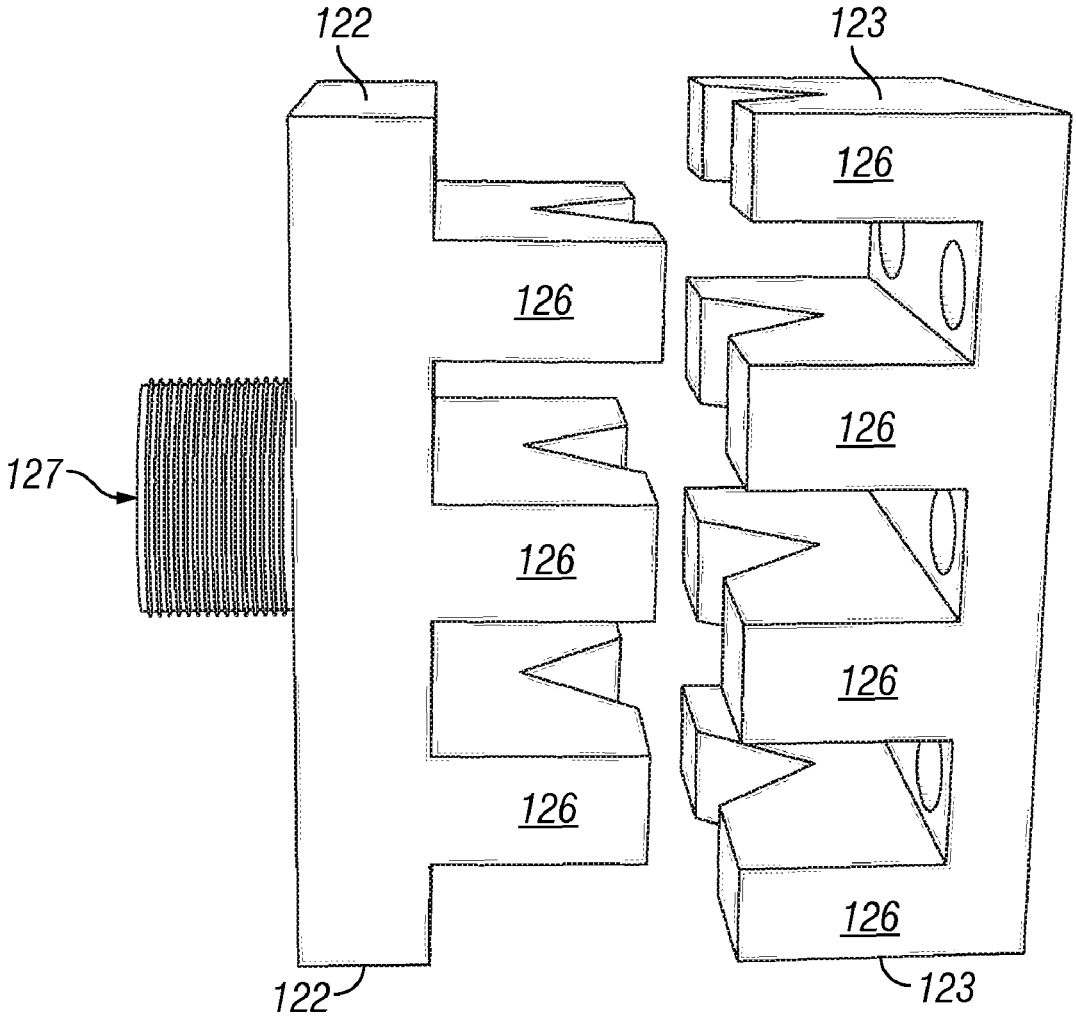

An embodiment of the clamp mechanism 110, best seen in FIGS. 2-4, may comprise a clamp housing or body 114 having a fixed end 116 having a hydraulic cylinder 118 (which may be a portion of the actuator 111) attached thereto and a substantially U-shaped end 120 removably attached to the fixed end 116 and defining a center portion 121 therebetween. Within the center portion 121 is disposed a jaw member 122 attached to the hydraulic cylinder 118, and a jaw member 123 attached to the end 120. Preferably, the jaw members 122 and 123 include an insert or gripper 124 disposed therein, best seen in FIG. 2. The gripper 124 may be removably mounted to each jaw member 122 and 123 and varied sized of grippers 124 may be utilized for engaging with cables of varied diameters, as will be appreciated by those skilled in the art. The gripper 124 defines an arcuate exterior surface 124*a* for engaging with an outside diameter of the cable 105. The U-shaped end 120 is removably attached to the fixed end 116 by a plurality of fasteners 125, such as threaded bolts or the like, which permit the clamp mechanism 110 to be installed on a cable when a user of the assembly 100 does not have access to a free end of the cable.

Referring to the schematic view of the jaw members 122 and 123 in FIG. 4, the jaw members 122 and 123 and the inserts 124 are shown removed from the housing 114. The jaw members 122 and 123 and/or the inserts 124 define opposed and interlocking V-shaped fingers 126, which are spaced apart along a length of the body 114 along a longitudinal axis 128 thereof, best seen in FIG. 3, to allow the interior surfaces of the V-shaped fingers 126 or the interior surface 124*a* of the inserts 124 to engage with an outside diameter of the cable 105 during operation, discussed in more detail below. The jaws 116 also have threaded studs 130 that protrude through the removable half of the frame to allow the operator to manually bolt the clamp mechanism 110 together and hold the cable in the event that the hydraulic cylinder 118 bleeds down or otherwise loses pressure.

Figure 5:
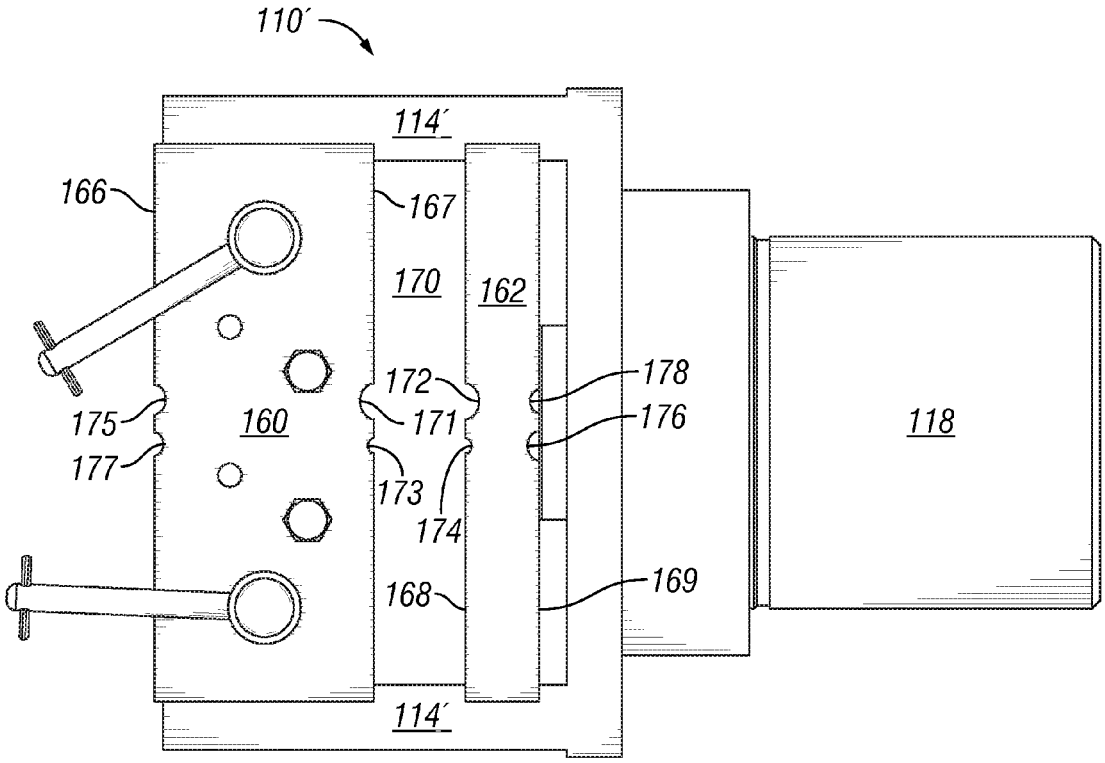
FIG. 5 is a schematic plan view of an embodiment of a clamp mechanism for an embodiment of a CCW assembly.
Figure 6:
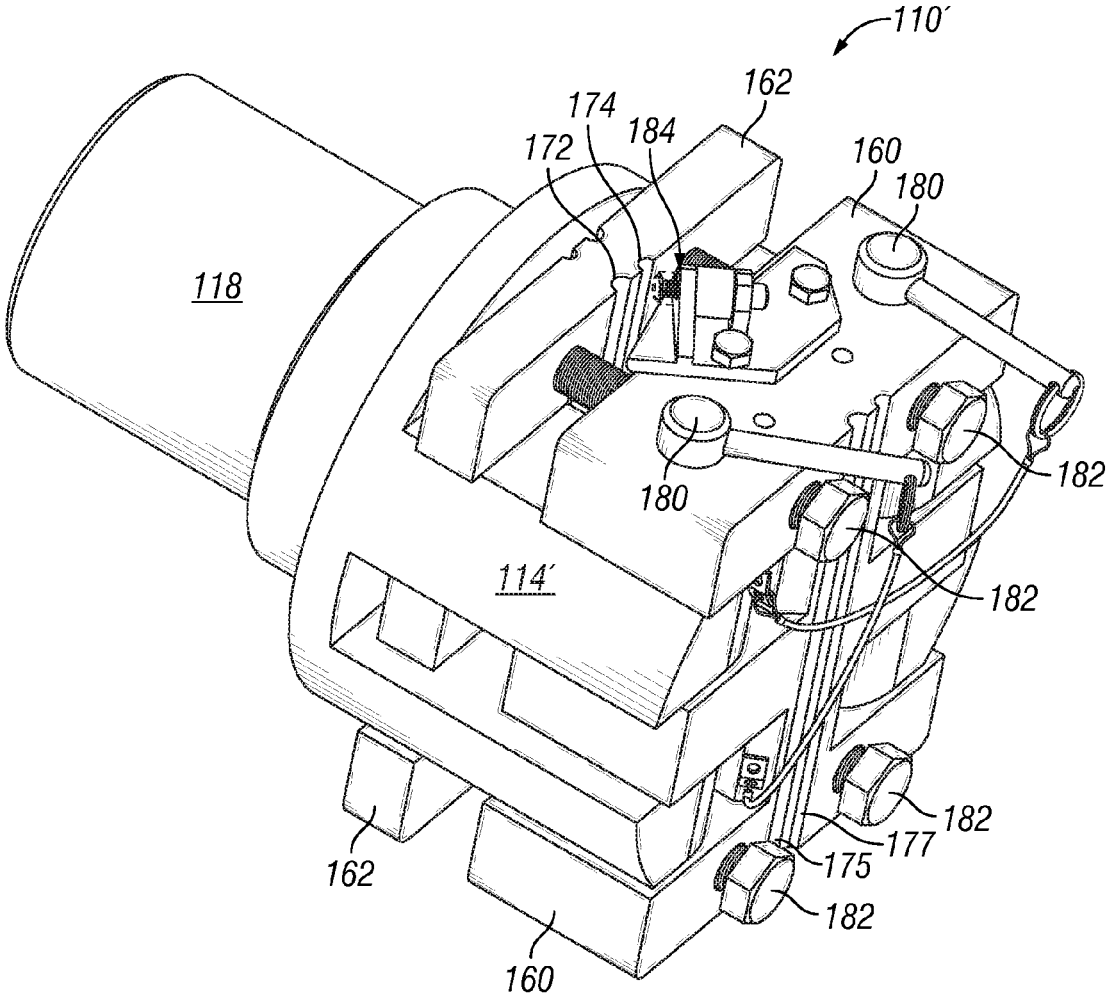
FIG. 6 is a schematic perspective view of an embodiment of a CCW assembly

An embodiment of a clamp mechanism is indicated generally at 110' in FIG. 5. The clamp mechanism 110' comprises a clamp housing or body 114' comprising a first fixed clamp plate 160 and a second moveable clamp plate 162 in opposed configuration. Each plate 160 and 162 define respective outer engagement surfaces 166, 167, 168, and 169. The plates 160 and 162 may be installed with either surface 166, 167, 168, and 169 to define a space 170 between the plates 160 and 162 through which the cable 105 may pass. The engagement surfaces 166, 167, 168, and 169 define corresponding grooves for engaging with varying sizes of cables 105 during operation of the clamp mechanism 110'. The surface 167 defines a groove 171 that corresponds to a groove 172 defined in the surface 168. The surface 167 defines a groove 173 that corresponds to a groove 174 defined in the surface 168. The grooves 171 and 172 define a different area than the grooves 173 and 174. Similarly, the surface 166 defines groove 175 and 177 that corresponds to groove 176 and 178 defined in the surface 168. Each corresponding groove 171 and 172, 173 and 174, 175 and 176, or 177 and 178 may be sized to engage with a different diameter cable 105. A pin or pins 180 may extend through the clamp plate 160 to removably attach the clamp plate 160 to the body 114' such as for reorienting the grooves 171, 173, 175, and 177 toward the space 170 and the clamp plate 162. A fastener or fasteners 182 may be attached to the clamp plates 160 and 162 to provide an additional force to clamp the clamping plates 160 and 162 together, such as if the cylinder 118 is failing or the like. A cable guide 184 may be attached at an upper portion of the clamp mechanism 110' for guiding the cable 105 to the correct grooves 171 and 172, 173 and 174, 175 and 176, or 177 and 178 in conjunction with a guide roller 106 or the like.

In operation, the hydraulic cylinder 118 acts on the jaw 122, such as by a connector 127 shown in FIG. 4, or the clamp plate 162 and forces the jaw 122 or the clam plate 162 toward the opposing jaw 123 or clamp plate 160, wherein the interior surfaces of the V-shaped fingers 126, a smooth interior surface 124*a* of the inserts 124, or the grooves 171, 172, 173, 174, 175, 176, 177, or 178 engage with an outside diameter of the cable 105 and clamp the cable 105. The geometry of the interior surfaces 124*a* of the inserts 124 and/or the interior surface of the fingers 126 are sized for engaging with an outside diameter of the cable and may be varied depending on the cable, as will be appreciated by those skilled in the art. The device or mechanism 110 can be prepared for and/or utilized with a variety of cables, such as logging cables or the like, having a multitude of outside diameters. The device 110 may be used for emergency recovery, and may permit an operator to use the clamp device 110 in much the same way as a tee bar clamp, with allowable tension above the rated working load for the cable. The orientation of the V-shaped fingers 126 advantageously provide self-centering capability with respect to engagement of the cable 105 with the interior surfaces 124*a*.

The CCW assembly 100 and the device or mechanism 110 may be installed in a subsea location, where the cable cutter, cable clamp, and cable wiper functions may be utilized and/or operated remotely for undersea operations, with suitable modifications made to the CCW assembly 100 for subsea use and conditions. Those skilled in the art will appreciate that the CCW assembly 100 may be adapted to be installed in a multitude of locations while remaining within the scope of the present invention.

The CCW assembly 100 advantageously combines the cable cutter, cable clamp, and cable wiper functions into a single portable unit, with a remote air-over-hydraulic control unit for the operator, and is preferably optimized to maximize cable tension as opposed to clamping pressure on the cable.

Another advantage of the CCW is that it can be put on the cable after the cable is in the well. In other words you do not have to thread the cable through the CCW. The CCW can be put on the cable after the fact The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A clamping, cutting, and wiping assembly assembly, comprising:

a frame defining a pathway for a cable to pass therethrough;

at least one roller guide mounted to the frame adjacent the pathway; and a clamp mechanism, a cutter device, and a wiper mounted to the frame adjacent the pathway for engaging with a cable, wherein the clamp device, the cutter, and the wiper are each remotely actuatable.

2. The assembly of claim 1 wherein each of the clamp mechanism, the cutter device, and the wiper further comprises an actuator for activating each of the clamp mechanism, the cutter device, and the wiper.

3. The assembly of claim 2 wherein the clamp mechanism defines a center portion for receiving the cable and a pair of opposing members for clamping the cable when actuated.

4. The assembly of claim 3 wherein the clamp mechanism is adjustable to clamp to selectable cable diameters.

5. The assembly of claim 4 wherein the clamp members define at least one groove on engagement surfaces thereof for engaging with the cable.

6. The assembly of claim 4 wherein the clamp members further comprises an insert removably disposed in at least one of the clamp members.

7. The assembly of claim 1 wherein the at least one roller guide is attached to the frame for moving the assembly along a surface.

8. The assembly of claim 1 wherein the assembly is adapted to be mounted in a subsea location.

9. The assembly of claim 1 wherein at least one of the clamp mechanism, the cutter device, and the wiper is attachable to the cable after the cable has been placed in a wellbore.

10. A clamping assembly for a cable entering a wellbore, comprising:

a housing defining a pathway for a cable to pass therethrough; and a clamp mechanism mounted to the housing and comprising at least a pair of opposing members for clamping and arresting movement of the cable, the opposing members adjustable to clamp to cables of selected diameters, wherein the opposing members define at least one groove on engagement surfaces thereof for engaging with the cable.

11. The assembly of claim 10 further comprising a cutter device, and a wiper mounted to the housing.

12. The assembly of claim 10 wherein the clamp mechanism further comprises a remotely operated actuator for actuating the clamp mechanism.

13. A clamping assembly for a cable entering a wellbore, comprising:

a housing defining a pathway for a cable to pass therethrough; and a clamp mechanism mounted to the housing and comprising at least a pair of opposing members for clamping and arresting movement of the cable, the opposing members adjustable to clamp to cables of selected diameters, wherein the opposing members further comprise an insert removably disposed in at least one of the opposing members.

14. The assembly of claim 13 wherein the clamp mechanism further comprises a remotely operated actuator for actuating the clamp mechanism.

* * * * *